United States Patent [19]

Hayashi et al.

[11] Patent Number: 4,700,664

[45] Date of Patent: Oct. 20, 1987

[54] COOLING SYSTEM FOR AUTOMOTIVE ENGINE OR THE LIKE

[75] Inventors: Yoshimasa Hayashi, Kamakura; Yutaka Minezaki, Koshigaya; Yoji Ito, Tokyo, all of Japan; Naoyuki Inoue, Alexandria, Va.; Yoshinori Hirano, Yokohama, Japan

[73] Assignee: Nissan Motor Co., Ltd., Yokohama, Japan

[21] Appl. No.: 747,248

[22] Filed: Jun. 21, 1985

[30] Foreign Application Priority Data

Jul. 6, 1984 [JP] Japan ..... 59-140059
Sep. 29, 1984 [JP] Japan ..... 59-202944

[51] Int. Cl.[4] ..... F01P 3/22
[52] U.S. Cl. ..... 123/41.27
[58] Field of Search ..... 123/41.2–41.27, 123/41.5; 165/104.27, 104.72

[56] References Cited

U.S. PATENT DOCUMENTS 3,168,080 2/1965 Latterner et al. ..... 123/41.5
3,312,204 4/1967 Barlow ..... 123/41.25
4,367,699 1/1983 Evans ..... 123/41.23

FOREIGN PATENT DOCUMENTS 135116 3/1985 European Pat. Off. ..... 123/41.21
135116 3/1985 European Pat. Off. ..... 41.21/

*Primary Examiner*—William A. Cuchlinski, Jr.
*Attorney, Agent, or Firm*—Schwartz, Jeffery, Schwaab, Mack, Blumenthal & Evans

[57] ABSTRACT

The cooling circuit of an internal combustion engine cooling system wherein the coolant is allowed to boil and the vapor used as a vehicle for removing heat from said engine is equipped with an external reservoir and arranged so that the amount of liquid coolant in the cooling circuit of the system can be varied in a manner which both assists in controlling the boiling point of the coolant and prevents the development of negative pressures which invite the invasion of non-condensible matter such as atmospheric air.

13 Claims, 17 Drawing Figures

SYSTEM CONTROL ROUTINE

WARM-UP CONTROL ROUTINE

TEMPERATURE CONTROL ROUTINE

COOLANT LEVEL CONTROL ROUTINE

COOLING SYSTEM FOR AUTOMOTIVE ENGINE OR THE LIKE

BACKGROUND OF THE INVENTION

1. Field of the Invention

The present invention relates generally to a cooling system for an internal combustion engine wherein liquid coolant permitted to boil and the vapor used as a vehicle for removing heat from the engine, and more specifically to such a system which is simple in construction and which enables rapid control of pressure prevailing in the cooling circuit thereof and which prevents the intrusion of contaminating air and/or the like non-condensible matter.

2. Description of the Prior Art

In currently used 'water cooled' internal combustion engine such as shown in FIG. 1 of the drawings, the engine coolant (liquid) is forcefully circulated by a water pump, through a cooling circuit including the engine coolant jacket and an air cooled radiator. This type of system encounters the drawback that a large volume of water is required to be circulated between the radiator and the coolant jacket in order to remove the required amount of heat. Further, due to the large mass of water inherently required, the warm-up characteristics of the engine are undesirably sluggish. For example, if the temperature difference between the inlet and discharge ports of the coolant jacket is 4 degrees, the amount of heat which 1 Kg of water may effectively remove from the engine under such conditions is 4 Kcal. Accordingly, in the case of an engine having 1800 cc displacement (by way of example) is operated full throttle, the cooling system is required to remove approximately 4000 Kcal/h. In order to achieve this, a flow rate of 167 liter/min (viz., $4000-60\times\frac{1}{4}$) must be produced by the water pump. This of course undesirably consumes a number of otherwise useful horsepower.

FIG. 2 shows an arrangement disclosed in Japanese Patent Application Second Provisional Publication Sho. 57-57608. This arrangement has attempted to vaporize a liquid coolant and use the gaseous form thereof as a vehicle for removing heat from the engine. In this system the radiator 1 and the coolant jacket 2 are in constant and free communication via conduits 3, 4 whereby the coolant which condenses in the radiator 1 is returned to the coolnat jacket 2 little by little under the influence of gravity.

This arrangement has suffered from the drawbacks that the radiator, depending on its position with respect to the engine proper tends to be at least partially filled with liquid coolant. This greatly reduces the surface area via which the gaseous coolant (for example steam) can effectively release its latent heat of vaporization and accordingly condense, and thus has lacked any notable improvement in cooling efficiency.

Further, with this system in order to maintain the pressure within the coolant jacket and radiator at atmospheric level, a gas permeable water shedding filter 5 is arranged as shown, to permit the entry of air into and out of the system. However, this filter permits gaseous coolant to readily escape from the system,inducing the need for frequennt topping up of the coolant level.

A further problem with this arrangement has come in that some of the air, which is sucked into the cooling system as the engine cools, tends to dissolve in the water, whereby upon start up of the engine, the dissolved air tends to form small bubbles in the radiator which adhere to the walls thereof forming an insulating layer. The undissolved air also tends to collect in the upper section of the radiator and inhibit the convention-like circulation of the vapor from the cylinder block to the radiator. This of course further deteriorates the performance of the device.

European Patent Application Provisional Publication No. 0 059 423 published on Sept. 8, 1982 discloses another arrangement wherein, liquid coolant in the coolant jacket of the engine, is not forcefully circulated therein and permitted to absorb heat to the point of boiling. The gaseous coolant thus generated is adiabatically compressed in a compressor so as to raise the temperature and pressure thereof and thereafter introduced into a heat exchanger (radiator). After condensing, the coolant is temporarily stored in a reservoir and recycled back into the coolant jacket via a flow control valve.

This arrangement has suffered from the drawback that air tends to leak into the system upon cooling thereof. This air tends to be forced by the compressor along with the gaseous coolant into the radiator. Due to the difference in specific gravity, the air tends to rise in the hot environment while the coolant which has condensed moves downwardly. The air, due to this inherent tendency to rise, forms pockets of air which cause a kind of 'embolism' in the radiator and badly impair the heat exchange ability thereof.

U.S. Pat. No. 4,367,699 issued on Jan. 11, 1983 in the name of Evans (see FIG. 3 of the drawings) discloses an engine system wherein the coolant is boiled and the vapor used to remove heat from the engine. This arrangement features a separation tank 6 wherein gaseous and liquid coolant are initially separated. The liquid coolant is fed back to the cylinder block 7 under the influence of gravity while the 'dry' gaseous coolant (steam for example) is condensed in a fan cooled radiator 8. The temperature of the radiator is controlled by selective energizations of the fan 9 to maintain a rate of condensation therein sufficient to maintain a liquid seal at the bottom of the device. Condensate discharged from the radiator via the above mentioned liquid seal is collected in a small reservoir-like arrangement 10 and pumed back up to the separation tank via a small constantly energized pump 11.

This arrangement, while providing an arrangement via which air can be initially purged to some degree from the system tends to, due to the nature of the arrangement which permits said initial non-condensible matter to be forced out of the system, suffers from rapid loss of coolant when operated at relatively high altitudes. Further, once the engine cools air is relatively freely admitted back into the system. The provision of the separation tank 6 also renders engine layout difficult.

Japanese Patent Application First Provisional Publication No. sho. 56-32026 (see FIG. 4 of the drawings) discloses an arrangement wherein the structure defining the cylinder head and cylinder liners are covered in a porous layer of ceramic material 12 and coolant sprayed into the cylinder block from shower-like arrangements 13 located above the cylinder heads 14. The interior of the coolant jacket defined within the engine proper is essentially filled with gaseous coolant during engine operation during which liquid coolant sprayed onto the ceramic layers 12. However, this arrangement has proved totally unsatisfactory in that upon boiling of the liquid coolant absorbed into the cramic layers, the vapor thus produced and which escapes into the coolant jacket inhibits the penetration of fresh liquid coolant and induces the situation wherein rapid overheat and thermal damage of the ceramic layers 12 and/or engine soon results. Further, this arrangement is plagued with air contamination and blockages in the radiator similar to the compressor equipped arrangement discussed above.

FIG. 7 shows an arrangement which is disclosed in copending U.S. patent application Ser. No. 663,911 filed on Oct. 23, 1984 in the name of Hirano. The disclosure of this application is hereby incorporated by reference thereto.

This arrangement while overcomming the problems inherent in the above discussed prior art suffers from the drawback of being overly complex in that a plurality of valves and conduits (valves 134, 152, 156 and 170 and conduits 150, 154 and 168) are required to execute the intended control thereof.

For convenience the same numerals as used in the above mentioned patent application are also used in FIG. 7.

SUMMARY OF THE PRESENT INVENTION

It is an object of the present invention to provide a cooling system for an internal combustion engine or the like device which permits liquid coolant to boil and uses the vapor generated as a vehicle for removing heat from the engine and which features a simple construction which controls the pressure prevailing in the system at a level which ensures that contaminating atmospheric air does not leak into the system and which enables the boiling point of the coolant can be rapidly and accurately controlled.

In brief, the above mentioned objects is achieved by a cooling system wherein the coolant is allowed to boil and the vapor used as a vehicle for removing heat from the engine and which is equipped with an external reservoir and arranged so that the amount of liquid coolant in the cooling circuit of the system can be varied in a manner which both assists in controlling the boiling point of the coolant and prevents the development of negative pressures which invite the invasion of non-condensible matter such as atmospheric air.

More specifically, the present invention comes in the form of an internal combustion engine which comprises: a structure subject to high heat flux and which features a cooling circuit for removing heat from the structure, the circuit including a coolant jacket formed about the structure and into which coolant is introduced in liquid form and permitted to boil, a radiator in which gaseous coolant is condensed to its liquid state, the radiator fluidly communicating with the coolant jacket via a vapor transfer conduit, and coolant return means for returning liquid coolant from the radiator to the coolant jacket in a manner to maintain the structure immersed in a predetermined depth of liquid coolant; and means for varying the amount of liquid coolant in the cooling circuit in a manner which controls the pressure prevailing within the cooling circuit.

BRIEF DESCRIPTION OF THE DRAWINGS

The features and advantages of the arrangement of the present invention will become more clearly appreciated from the following description taken in conjunction with the accompanying drawings in which.

DETAILED DESCRIPTION OF THE PREFERRED EMBODIMENTS

Before proceeding with the description of the embodiments of the present invention, it is deemed appropriate to discuss the concept on which the present invention is based.

Figure 1:
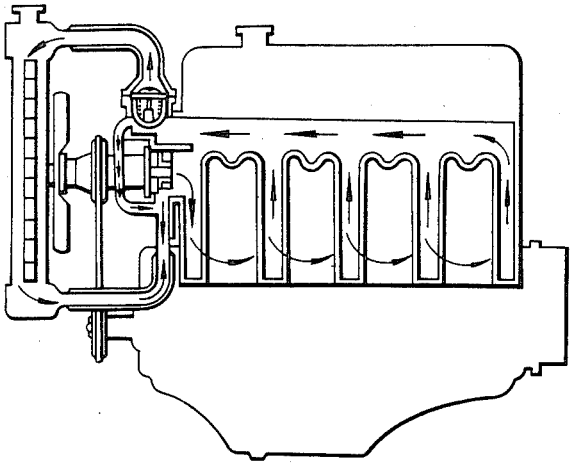
FIG.1 (PRIOR ART)
FIG. 1 is a partially sectioned elevation showing the currently used conventional water circulation type system discussed in the opening paragraphs of the instant disclosure.
Figure 2:
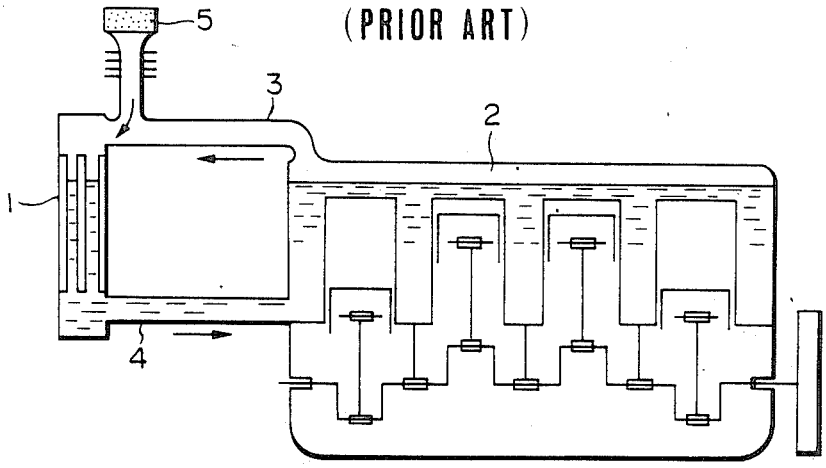
FIG.2 (PRIOR ART)
FIG. 2 is a schematic side sectional elevation of a prior art arrangement also discussed briefly in the earlier part of the specification.
Figure 3:
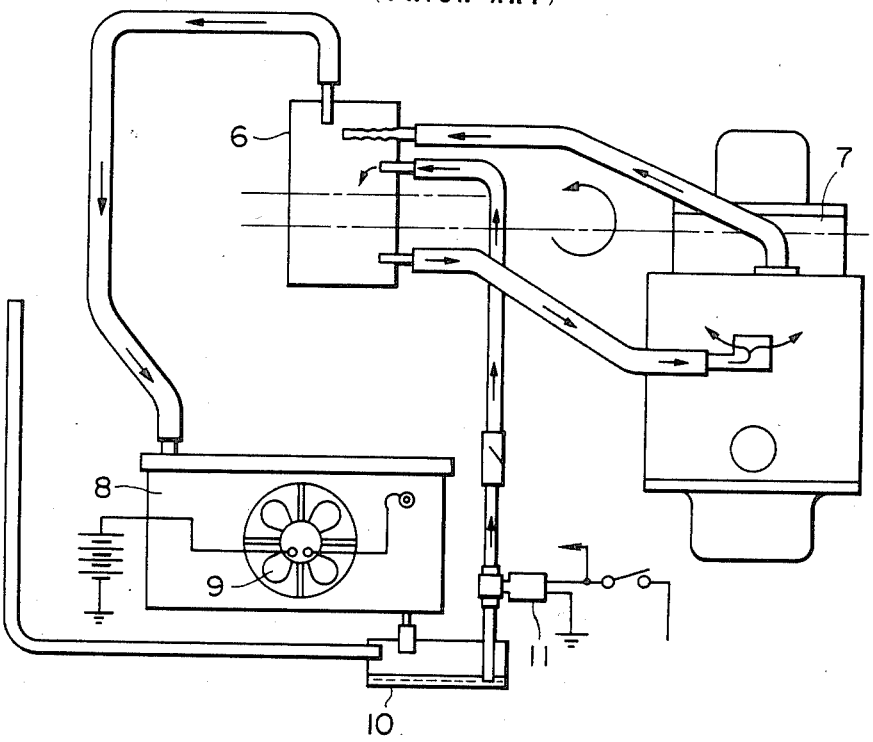
FIG. 3 (PRIOR ART)
FIG. 3 shows in schematic layout form, another of the prior art arrangements previously discussed.
Figure 4:
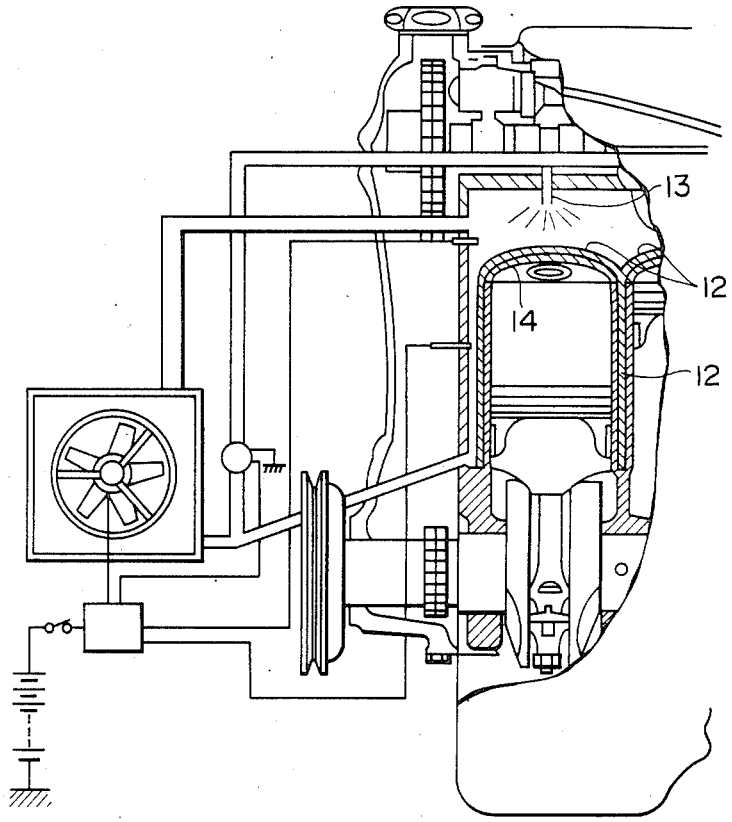
FIG.4 (PRIOR ART)
FIG. 4 shows in partial section yet another of the previously discussed prior art arrangements.
Figure 5:
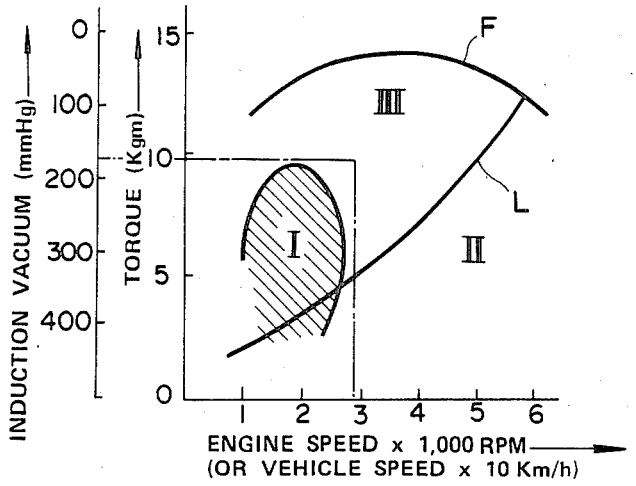
FIG. 5 is a graph showing in terms of induction vacuum (load) and engine speed the various load zones encountered by an automotive internal combustion engine.
Figure 6:
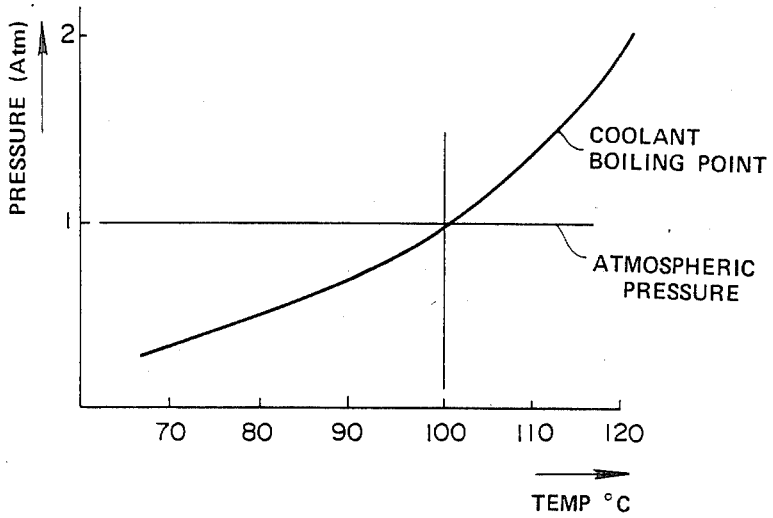
FIG. 6 is a graph showing in terms of pressure and temperature, the change which occurs in the coolant boiling point with change in pressure.

FIG. 5 graphically shows in terms of engine torque and engine speed the various load 'zones' which are encountered by an automotive vehicle engine. In this graph, the curve F denotes full throttle torque characteristics, trace L denotes the resistance encountered when a vehicle is running on a level surface, and zones I, II and III denote respectively 'urban cruising', 'high speed cruising' and 'high load operation' (such as hill-climbing, towing etc.).

A suitable coolant temperature for zone I is approximately 110° C. while 90°-80° C. for zones II and III. The high temperature during 'urban cruising' promotes improved thermal efficiency while simultaneously removing sufficient heat from the engine and associated structure to prevent engine knocking and/or engine damage in the other zones. For operational modes which fall between the aforementioned first, second and third zones, it is possible to maintain the engine coolant temperature at approximately 100° C.

Figure 7:
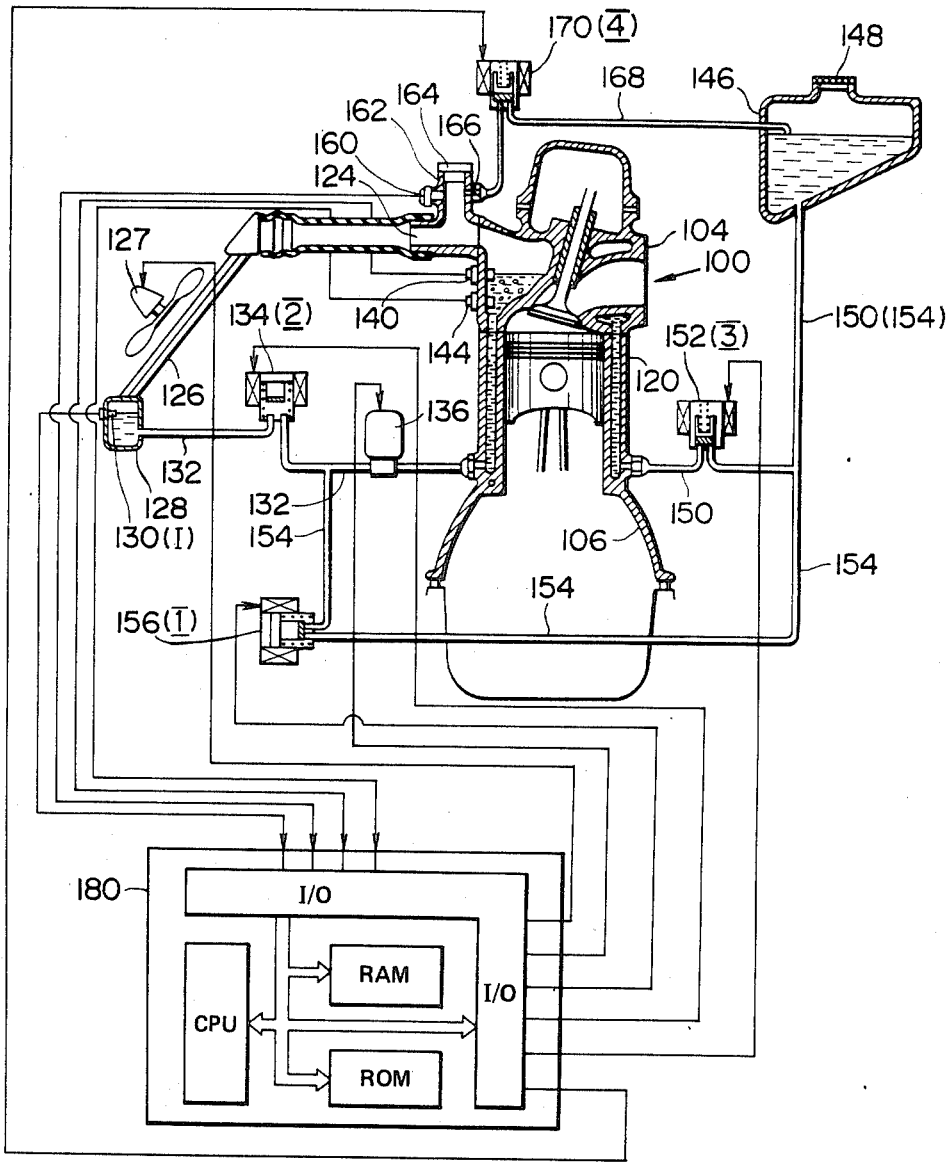
FIG. 7 shows in schematic elevation the arrangement disclosed in the opening paragraphs of the instant disclosure in conjunction with copending U.S. Pat. No. 6,631,911.

With the present invention, in order to control the temperature of the engine, advantage is taken of the fact that with a cooling system wherein the coolant is boiled and the vapor used a heat transfer medium, the amount of coolant actually circulated between the coolant jacket and the radiator is very small, the amount of heat removed from the engine per unit volume of coolant is very high, and upon boiling, the pressure prevailing within the coolant jacket and consequently the boiling point of the coolant rises if the system employed is closed. Thus, by circulating only a limited amount of cooling air over the radiator, it is possible reduce the rate of condensation therein and cause the pressure within the cooling system to rise above atmospheric and thus induce the situation, as shown in FIG. 7, wherein the engine coolant boils at temperatures above 100° C. for example at approximately 119° C. (corresponding to a pressure of approximately 1.9 Atmospheres). In addition to the control afforded by the air circulation it is possible according to the present invention to vary the amount of coolant in the cooling circuit of the system in a manner which modifies the pressure prevailing therein. The combination of the two controls enables the temperature at which the coolant is permitted to boil to be held close to that deemed most appropriate for the instant set of operation conditions.

On the other hand, during high speed cruising, it is further possible by increasing the flow cooling air passing over the radiator, to increase the rate of condensation within the radiator to a level which reduces the pressure prevailing in the cooling system below atmospheric and thus induce the situation wherein the coolant boils at temperatures in the order of 80° to 90° C. However, under such conditions the tendency for air to find its way into the interior of the cooling circuit becomes excessively high and it is desirable under these circumstances to limit the degree to which a negative pressure is permitted to develop. This can be achieved by permitting coolant to be introduced into the cooling circuit from the reservoir and thus raise the pressure in the system to a suitable level.

Moreover, under certain circumstances, such as prolonged downhill coasting or during extremely cold weather, it is possible that the rate of condensation in the radiator becomes excessive, lowering the boiling point of the coolant below that desired under such conditions and inducing a negative pressure sufficient to collapse the hosing and/or crush some of the engine apparatus. Accordingly, the present invention features and arrangement for reducing the heat exchange capacity of the radiator and thus limit the amount of heat which may be removed from the engine. In the embodiments of the present invention, this reduction in heat exchange capacity is also achieved by introducing liquid coolant into the cooling circuit in a manner to partially fill the radiator.

This partial filling reduces the surface area available for the vapor to release its latent heat of vaporization and thus the amount of heat which may be released from the system. It should be noted however, that the present invention is not specifically limited to this particular technique and encompasses other methods such as the provision of shields, louvers etc.

Figure 8:
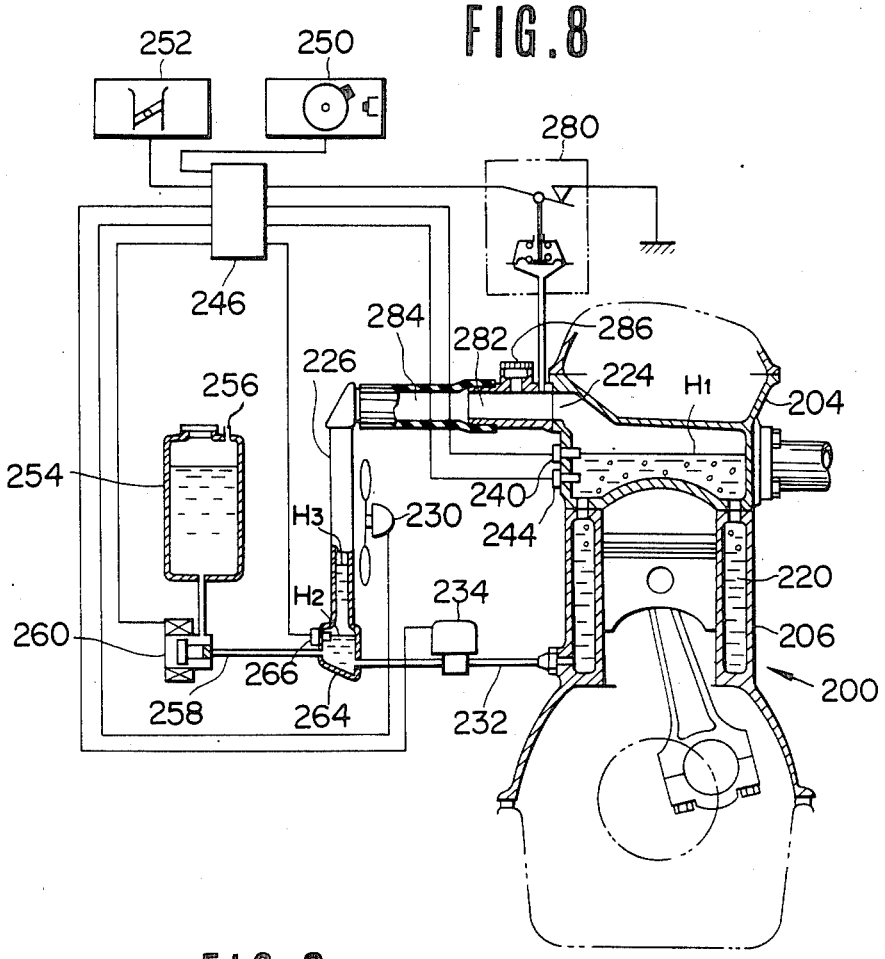
FIG. 8 shows in sectional elevation a first embodiment of the present invention.

FIG. 8 shows an engine system incorporating a first embodiment of the present invention. In this arrangement, an internal combustion engine 200 includes a cylinder block 206 on which a cylinder head 204 is detachably secured. The cylinder head and cylinder block include suitable cavities which define a coolant jacket 220 about the heated structure of the cylinder head and block.

Fluidly communicating with a vapor discharge port 224 of the cylinder head 204 is a radiator or heat exchanger 226. If deemed advantageous a mesh screen or like separator (not shown) can be disposed in the vapor discharge port of the cylinder head so as to minimize the transfer for liquid coolant which tends to froth during boiling, to the radiator 226.

Located suitably adjacent the radiator 226 is a electrically driven fan 230. Disposed in a coolant return conduit 232 is a return pump 234. In this embodiment, the pump is driven by an electric motor and arranged to introduce the cool discharged therefrom, into the lowermost portion of the coolant jacket 220.

In order to control the level of coolant in the coolant jacket, a level sensor 240 is disposed as shown. It will be noted that this sensor is located at a level ($H_1$) which is higher than that of the combustion chambers, exhaust ports and valves (structure subject to high heat flux) so as to maintain same securely immersed in coolant and therefore attenuate engine knocking and the like due to the formation of localized zones of abnormally high temperature or 'hot spots'.

Located below the level sensor 240 so as to be immersed in the liquid coolant is a temperature sensor 244. The output of the level sensor 240 and the temperature sensor 244 are fed to a control circuit 246 or modulator which is suitably connected with a source of EMF (not shown).

The control circuit 246 further receives an input from the engine distributor 250 (or like device) indicative of engine speed and an input from a load sensing device 252 such as a throttle valve position sensor. It will be noted that as an alternative to throttle position, the output of an air flow meter, an induction vacuum sensor or a fuel injection control signal may be used to indicate load.

A coolant reservoir 254 is located beside the radiator 226 as shown. An small air bleed 256 permits atmospheric pressure to continuously prevail therein.

The reservoir 254 fluidly communciates with the cooling circuit via a supply conduit 258 and an electromagnetic valve 260. This valve is closed when energized. As shown, the supply conduit 258 is arranged to to communicate with a small collection tank 264 or lower tank as it will be referred to hereinlater, which is formed at the base of the radiator 226.

A second level sensor 266 is disposed in the lower tank 264.

In this embodiment a pressure responsive diaphragm operated switch 280 is arranged to communicate with a vapor manifold 282. This manifold, as shown, provides fluid communication between the vapor discharge port 224 and the radiator 226 via a transfer conduit 284. Switch 280 is arranged to be normally closed and open only when a negative pressure in excess of a predetermined low level prevails in the system. In this embodiment it is deemed advantageous to set the switch to assume an open (OFF) state when the pressure in the cooling circuit assumes a value of Atmospheric+10 mm Hg.

Prior to use the cooling circuit is filled to the brim with coolant (for example water or a mixture of water and antifreeze or the like) and a cap 286 securely set in place to seal the system (see FIG. 8). A suitable quantity of additional coolant is also placed in the reservoir 254. At this time the electromagnetic valve 260 should be temporarily energized or a similar precaution be taken to facilitate the complete filling of the system and the exclusion of any air.

When the engine is started, as the coolant jacket 220 is completely filled with stagnant coolant, the heat produced by the combustion in the combustion chambers cannot be readily released via the radiator 226 to the ambient atmosphere and the coolant rapidly warms and begins to produce coolant vapor. At this time valve 260 is left de-energized whereby the pressure of the coolant vapor begins displacing liquid coolant out of the cooling circuit (viz., the coolant jacket 220, vapor manifold 282, vapor conduit 284, radiator 226, lower tank 264 and the return conduit 232). During this 'coolant displacement mode' it is possible for one of two situations to occur. That is to say, it is possible for the level of coolant in the coolant jacket 220 to be reduced to level H1 before the level in the radiator reaches level H2 or vice verse wherein the radiator 226 is emptied before much of the coolant in the coolant jacket is displaced. In the event that latter occurs (viz., the coolant level in the radiator 226 falls to H2 before that in the coolant jacket 220 reaches H1), valve 260 is temporarily closed and the coolant in the coolant jacket allowed to distill across (viz., boil over) to the radiator. Alternatively, if the level H1 is reached first, level sensor 240 induces the energization of pump 234 and coolant is pumped from the radiator to the coolant jacket 232 while simultaneously being displaced out through conduit 266 to reservoir 254.

During this displacement mode, the load and other operational parameters of the engine are sampled and a decision made as to the temperature at which the coolant should be controlled to boil. If the desired temperature is reached before the amount of the coolant in the cooling circuit is reduced to the minimum quantity (viz., when the coolant in the coolant jacket and the radiator are at levels H1 and H2 respectively) it is possible to energize valve 260 so that is assumes a closed state and places the cooling circuit in a hermetically closed condition. If the temperature at which the coolant boils should exceed that determined to be best suited for the instant set of engine operational conditions, the circuit may be subsequently reopened and additional coolant displaced out to reservoir 226 to increase the surface 'dry' surface area of the radiator 226 available for the coolant vapor to release its latent heat of evaporation.

On the other hand, should the ambient conditions be such that the rate of condensation in the radiator is higher than that desired (viz., overcooled) and the pressure within the system overly lowered to assume a subatmospheric level, the pressure differential responsive switch device 280 assumes an open state and the control circuit 246 induced to de-energize and open valve 260. This of course permits coolant to be forced from the reservoir 254 into the lower tank 264 and up into the radiator until it reaches level H3 (by way of example). With this measure, the pressure prevailing in the cooling circuit is raised to atmospheric level and the surface area available for heat exchange reduced. Accordingly, the boiling point of the coolant is immediately modified by the change in internal pressure while the amount of heat which may be released from the system reduced. Accordingly, it is possible to rapidly elevate the boiling point to that determined to be necessary.

When the engine is stopped it is advantageous with the present invention to maintain valve 260 energized until the switch arrangement 280 opens. This obviates the problem wherein large amounts of coolant are violently discharged from the cooling circuit due to the presence of superatmospheric pressure therein.

Figure 9:
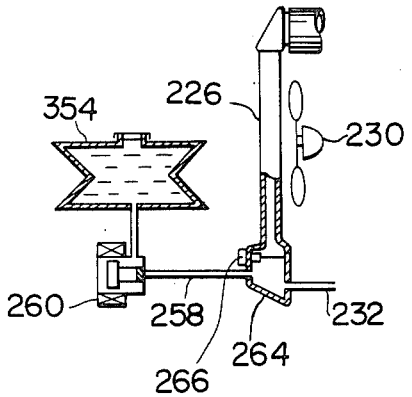
FIG. 9 is a sectional view of a reservoir which characterizes the construction of a second embodiment of the present invention.

FIG. 9 shows a reservoir arrangement which characterizes a second embodiment of the present invention. In this arrangement the reservoir shown in FIG. 8 (first embodiment) is replaced with a variable volume arrangement which in this case takes the form of a flexible bellows-like compressible container 354.

This arrangement permits the reservoir to be maintained hermetically sealed at all times and thus obviates the tendancy for air to slowly dissolve in the coolant contained therein. This of course prevents the phenomenon wherein air which dissolves little by little in the coolant contained in the reservoir finds its way into the coolant circuit when the engine is stopped and a large amount of coolant contained in the reservoir is induced into the elements constituting the coolant circuit. This air tends to come out of solution upon engine start up and the subsequent warming of the coolant which marks the beginning of the excess coolant displacement mode.

Accordingly, the second embodiment of the present invention exhibits improved resistance to contamination by atmospheric air which as previously explained can badly impair the efficiency of the condenser or radiator of the system.

Figure 10:
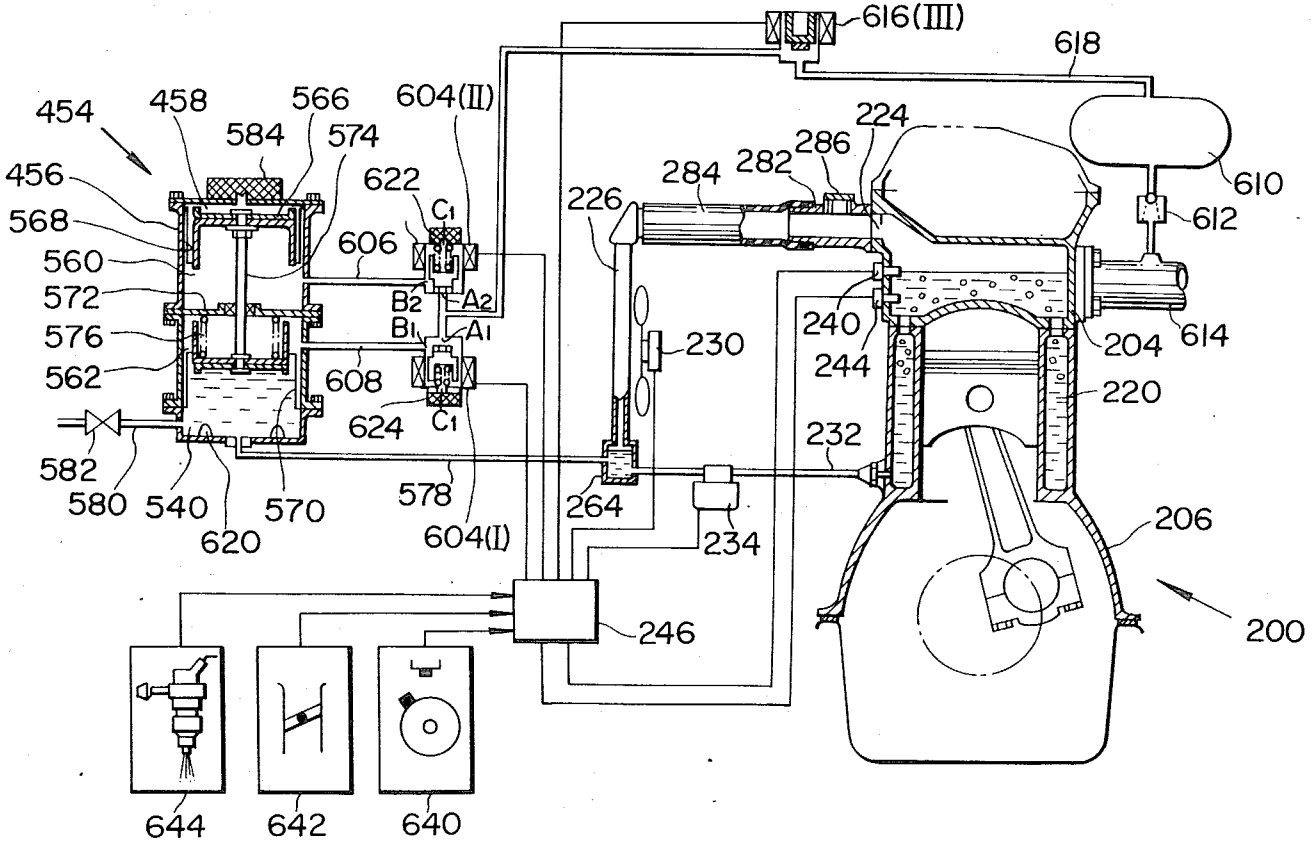
FIG. 10 is a sectional view of a third embodiment of the present invention.

FIG. 10 shows a third embodiment of the present invention. In this embodiment the reservoir 454 takes the form of a housing 456 which is partitioned into first, second, third and fourth variable volume chambers 458, 560, 562 and 564 by a double headed piston 566 and two flexible diaphragms 568, 570 (one attached to each of the piston heads).

A rigid partition 572 through which a shaft 574 of the piston is disposed, hermetically separates the second and third chambers 560, 562. A spring 576 is disposed in the third chamber 562 and arranged to bias the piston 566 in a direction which tends to minimize the volume of the fourth chamber 564. This latter mentioned chamber 564 is. as shown, filled with liquid coolant and arranged to constantly communicate with the lower tank 264 via conduit 578. A fill conduit 580 through which fresh coolant can be charged into the fourth chamber 564 is controlled by a normally closed manually operable valve 582. As the fourth chamber of the reservoir unit is constantly communicated with the lower tank 264 the need for the second level sensor 266 is eliminated.

First chamber 458 is arranged to communicate with the ambient atmosphere via an air filter 584, while the second and third chambers 560, 562 communicate with a source of vacuum via a control valve arrangement which in this embodiment takes the form of two three-way valves 602, 604 and corresponding supply conduits 606, 608.

The vacuum source in this arrangement takes the form of a vacuum reservoir 610 from which air is extracted through a one-way valve 612. This valve is arranged to communicate with the induction manifold 614 of the engine 200 and thus be exposed to the vacuum which develops therein when the engine is running. A cut-off valve 616 is disposed in a conduit 618 which leads from the vacuum reservoir 610 to the control valve arrangement.

To limit the travel of the piston 566 in a direction which reduces the volume of the fourth chamber 564, a plurality of stoppers 620 are disposed as shown.

With this arrangement when the engine is stopped, power to valves 602, 604 and 616 is cut-off whereby valve 616 assumes a closed position while valves 602, 604 assume positions wherein the second and third chambers 560, 562 are communicated with the atmosphere via small filters 622, 624 to exclude dust and the like for accumulating in the valves and inducing malfunction of same.

Under these conditions, as atmospheric pressure prevails in the first, second and third chambers 458, 560 and 562 the piston 566 tends to be urged downwardly (as seen in the drawings) under the influence of spring 576 and thus tend to force coolant into the cooling circuit via the lower tank 264. In the event that the engine is cold this arrangement tends to ensure that the cooling circuit is completely filled and can, if so desired, even positively pressurize same to a slight extent. This securely prevents any tendancy for air or the like non-condensible matter to finds its way into the cooling system via the gasketing and the like disposed between the various elements which constitute the engine arrangement.

FIGS. 11 to 17 are flow charts depicting the control steps which characterize the operation of the third embodiment. For the ease of explanation valves 604, 602 and 616 will be referred to as valves I, II and III respectively, while the vacuum, modulated pressure and atmospheric ports of valves I and II will be referred to as A1, A2, B1, B2, C1 and C2 respectively.

Figure 11:
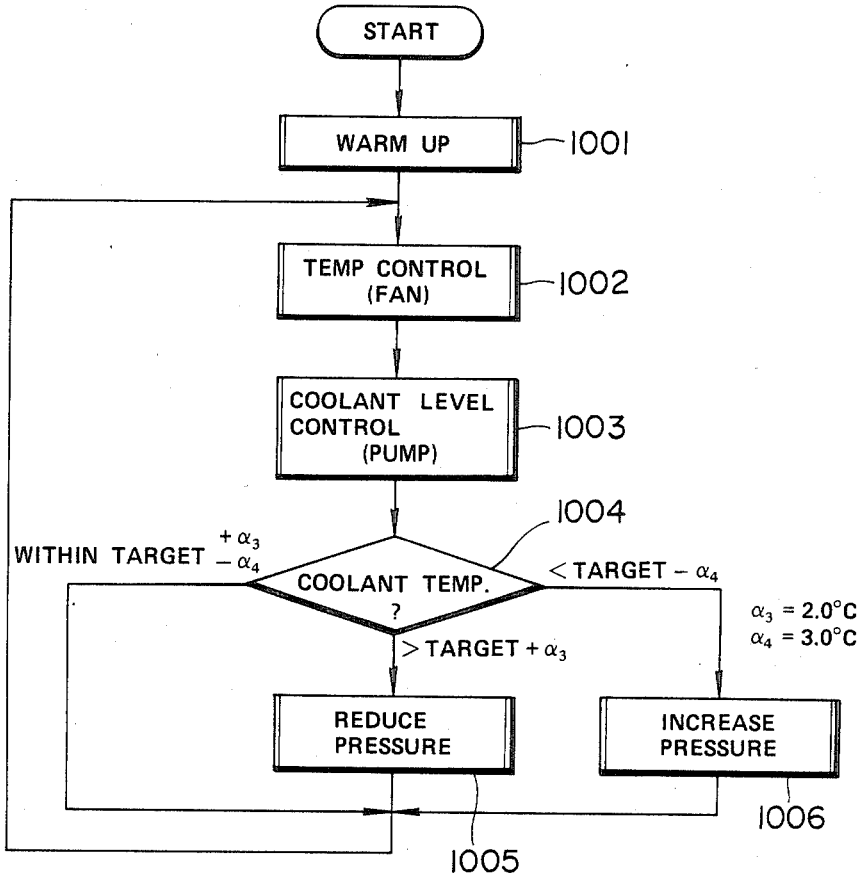
FIGS. 11 to 17 are flow charts depicting the steps which characterize the control of the arrangement shown in FIG. 10.

FIG. 11 shows the system control routine which controls the operation of the above described arrangement. This routine includes a warm-up control sub-routine 1001, a fan control sub-routine 1002 which controls the rate of condensation in the radiator 226 via fan energizations, a coolant level control sub-routine which controls the operation of pump 234, a temperature ranging step 1004 and pressure reducing and increasing sub-routines 1005 and 1006.

Each of the above mentioned routines will be set forth in detail hereinlater.

Figure 12:
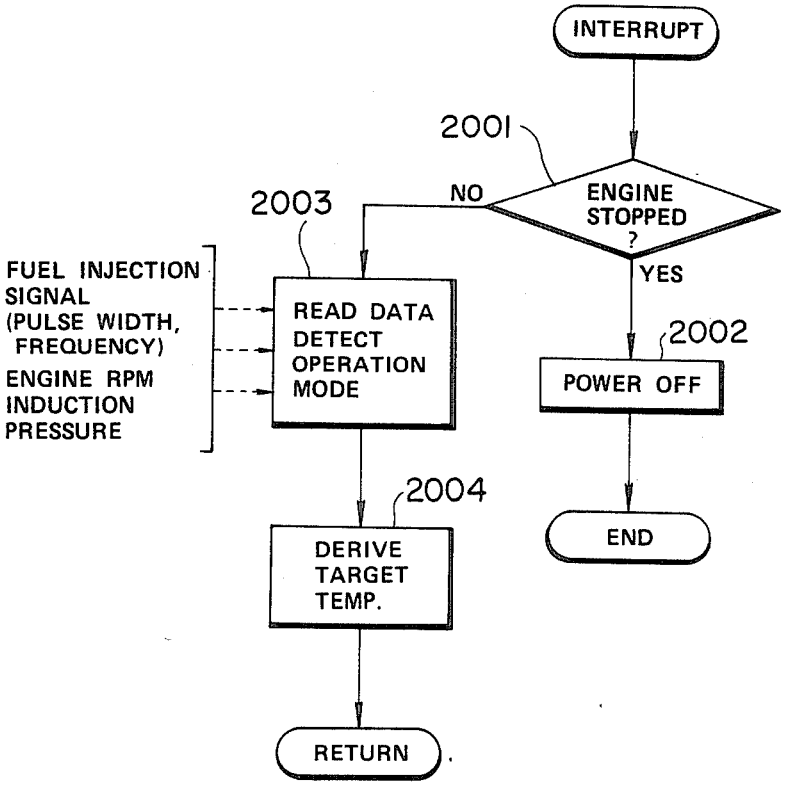

FIG. 12 shows an interrupt routine which is periodically run to determine if the engine is running or not and to, in the event that the engine is running, determine the temperature to which the coolant should be controlled to boil at. As shown, this routine at step 2001 determines if the engine is running or not. This of course may be carried out by sampling the output of the engine speed sensor 640 by way of example. If the answer to this enquiry shows that the engine is not running then at step 2002 the power to the entire system is terminated. However, if the engine is running then at step 2003 input data such as the pulse width and frequency of a fuel injection signal (if available) and/or a engine speed signal and an induction pressure signal are read and a determination made as to which mode of operation the vehicle engine is currently undergoing. For example, by comparing the sampled engine speed with the induction vacuum or alternatively the fuel injection frequency with the pulse width of the same signal it can be determined which of the load zones shown in FIG. 5 the engine is operating in.

At step 2004 the appropriate temperature for the instant mode of operation is determiend and set in RAM.

Although not specifically shown in FIG. 10 it will be of course appreciated that the control circuit 246 includes a microprocessor (similar to that shown in FIG. 7) which can execute programs of the nature depicted in the flow charts of FIGS. 11 to 17.

Figure 13:
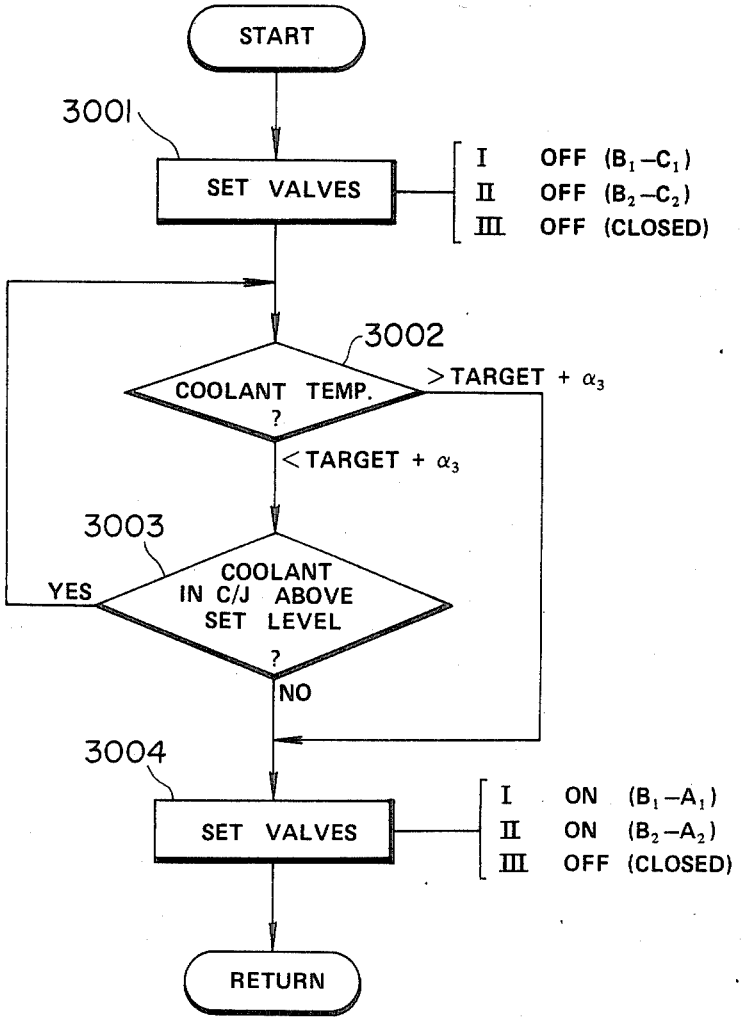

FIG. 13 shows in detail the 'warm-up control routine' (step 1001 of FIG. 11). As shown, subject to the start of this program valves I, and II and III are conditioned as shown. Under these conditions atmospheric pressure is supplied to the second and third chambers of the reservoir unit. Viz., the control valve assume a condition similar to that when the engine is shut-down and not in use. However, as the coolant warms and produces vapor pressure, the coolant in the coolant jacket (denoted by the symbol C/J) in the flow charts), it is displaced out of the cooling circuit and into the fourth chamber of the reservoir unit 454.

At step 3002 the output of the temperature sensor 244 is sampled and a determination if the temperature of the cooclant is above or below the target temperature (derived in step 2003 of the interrupt program) by a value of $\alpha 3$ (wherein $\alpha 3$ is 2.0° C.) or not. In the event that the coolant temperature is above the target value by an amount greater than 2.0° C. then the program flows to step 3003 wherein the control valves are conditioned as shown. However, in the event that the temperature of the coolant has not as yet reached the target value then at step 3003 the output of the coolant jacket level sensor 240 is sampled and it is determined if the level of coolant is above level H1 or not.

In the event that the level of coolant in the coolant jacket is still above level H1 then the program recycles to step 3002. However, if the coolant level has fallen to level H1 then the program flows to step 3004.

Upon the valves being conditioned as shown in step 3004 the supply of vacuum is terminated by the closure of valve III and valves I and II conditioned to equalize the pressures in the second and third chambers of the reservoir unit 454. Accordingly, the system is induced to assume a condition wherein movement of the piston can be quickly induced by modulating the pressure fed to one of the two chambers when valve III is opened.

Figure 14:
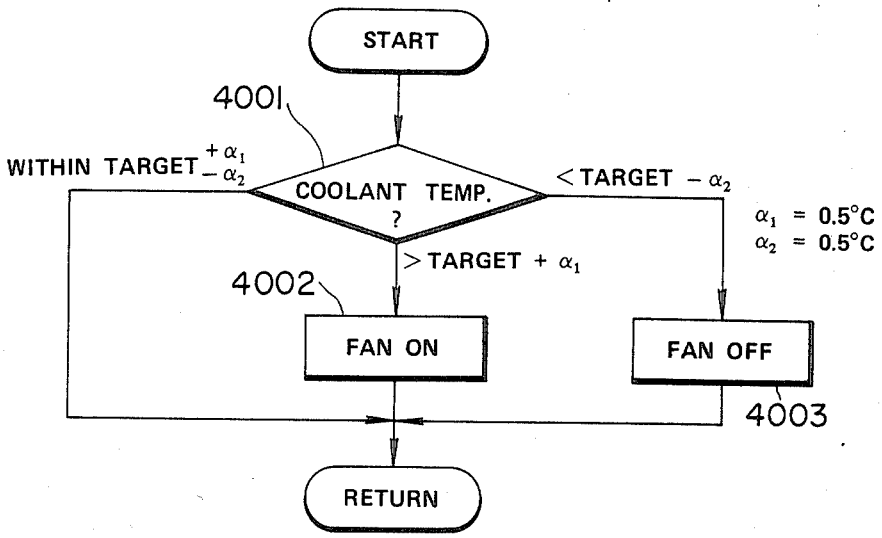

FIG. 14 depicts the steps which characterize the temperature control which is achieved by varying the heat exchange between the radiator 226 and the ambient atmosphere. In this program the output of the temperature sensor 244 is sampled at step 4001, compared with the derived target temperature and ranged in a manner as shown. Viz., if the sampled temperature falls within a range of TARGET $-\alpha 2$ then the program terminates. However, in the event that the sampled value is above TARGET by $\alpha 1$ than the fan 226 is energized at step 4002. On the other hand, if the coolant temperature is found to be lower than TARGET $-\alpha 2$ then the operation of the fan 230 is inhibited in step 4003.

This program is designed to hold the temperature of the coolant within a range of TARGET ±0.5° C.

Figure 15:
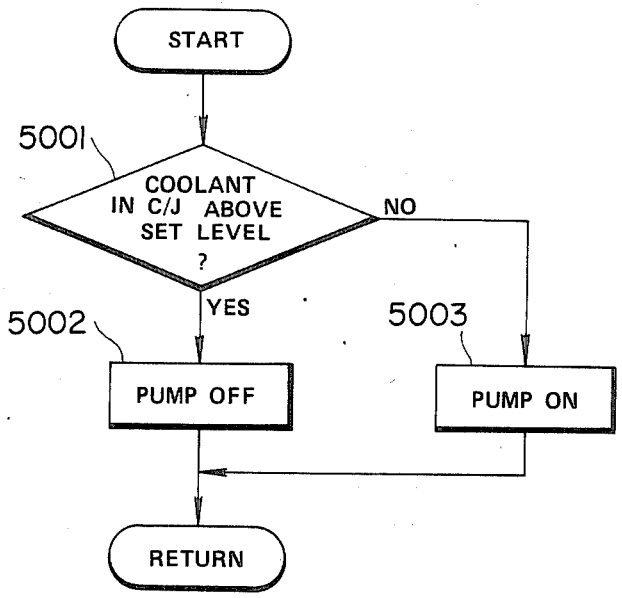

FIG. 15 shows a routine which controls the level of the coolant within the coolant jacket 220 in a manner which ensures that the structure such as the cylinder head, exhaust valve and ports is constantly immersed in sufficient liquid as to prevent the formation of hot spots due to sporadic 'bumping' of the coolant as it boils.

At step 5001 the output of level sensor 240 is sampled and the determination made if the level of coolant in the coolant jacket is above or below level H1. In the event that the level is at or above H1 then the operation of the pump 234 is prevented (step 5002) while if lower than same energization of the pump is induced at step 5002.

It will be noted that with the present invention it is possible to arranged the level sensors 240 and 266 to take the form of reed switches which have float arrangements or the like and for the sensors to exhibit hysteresis characteristics to obviate rapid on-off cycling of the pump motor. Viz., the sensors can be arranged so that they continue to issue a low level signal until the level of coolant in the coolant jacket has actually be raised by predetermined amount above level H1.

Figure 16:
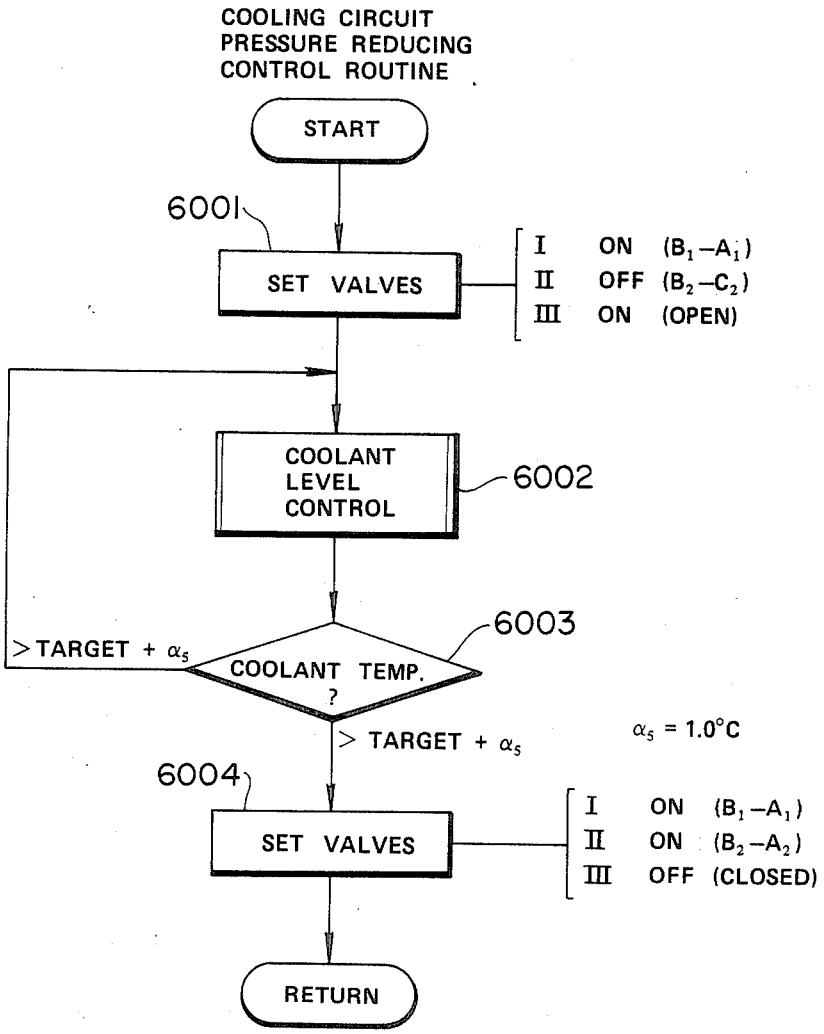

FIG. 16 shows the steps which are implemented with the present invention in order to reduce the pressure prevailing in the coolant jacket. As shown subsequent to the start of this program valve I, II and III are set as shown. With the valves conditioned as shown, vacuum is supplied to the third chamber 562 while atmospheric pressure is permitted to prevail in chamber 560. Under these circumstances as the pressure differential between the first and second chambers 458, 560 is reduced to zero, the pressure of the liquid coolant in the fourth chamber 564 biases piston 574 up against the bias of the spring thus increasing the volume of the fourth chamber and reducing that of the third which is still maintained in a semi-evacuated state. This allows coolant to flow out of the cooling circuit via conduit 578 and thus expand the gas within the circuit reducing the pressure thereof. This immediately lowers the boiling point of the coolant. It should be noted that maximumm volume of the fourth chamber is so selected that (as illustrated in FIG. 10) more than the previously mentioned minimum quantity of coolant cannot be removed from the cooling circuit.

At step 6002 the coolant control routine shown in detail in FIG. 15 is implemented. Subsequently at step 6003 the output of the temperature sensor 244 is sampled and the instant coolant temperature compared with the most recently derived target value. In the event that the temperature of the coolant is still above the target level by a value of $\alpha 5$ then the program recycles to step 6002. However, if the temperature has fallen to a level which is less than TARGET $+\alpha 5$ (wherein $\alpha 5 = 1.0°$ C.) then at step 6004 the control valves are conditioned so that again valve III is closed to cut off supply of vacuum from the vacuum source while valves I and II are arranged to establish communication between ports A1-B1 and A2-B2.

Figure 17:
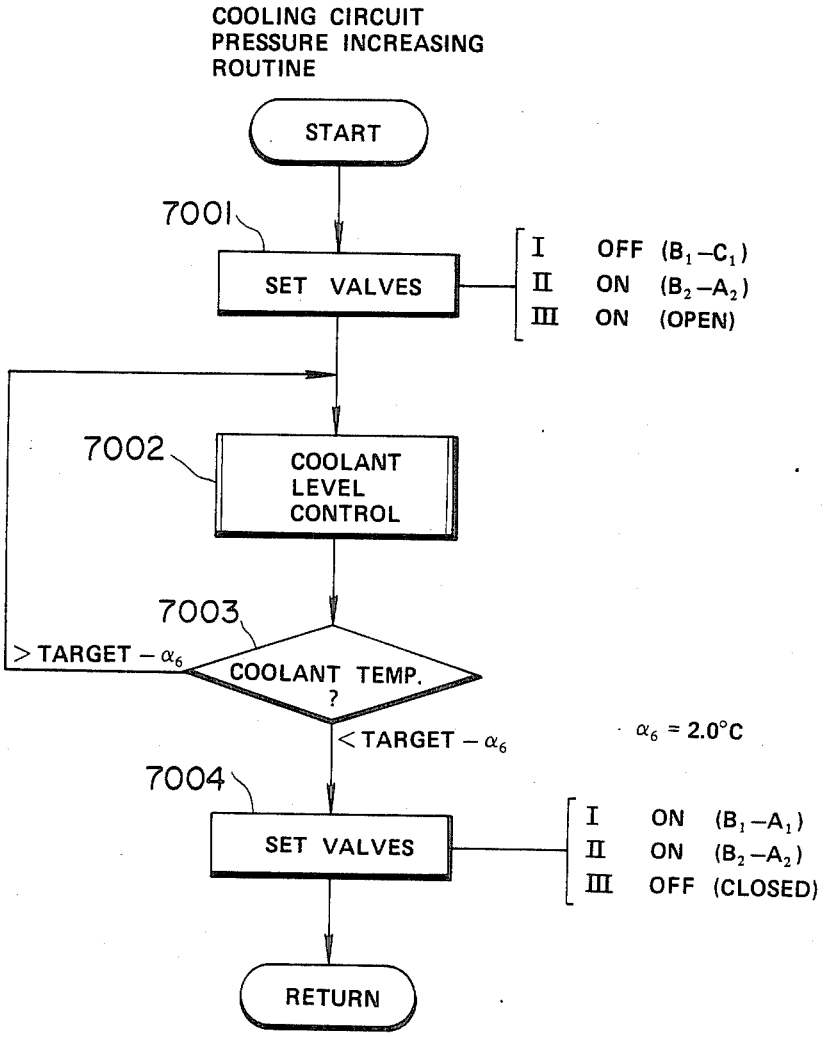

FIG. 17 shows the steps which characterize a program which increases the pressure within the cooling circuit. Subsequent to the start of this program the valves I, II and III are conditioned in step 7001 as shown. With this, vacuum is selectively supplied to chamber 560 whereby the pressure differential across diaphragm 568 produces a bias which in addition to that produced by spring 576 forces coolant out the fourth chamber 564 and into the coolant circuit. This raises the level of coolant in the radiator 226 compressing the gas within the cooling circuit (raising the coolant boiling point) and simultaneously reducing the surface area via which the latent heat of evaporation of the gaseous coolant can be released to the surrounding atmosphere. At step 7002 the coolant level control routine is executed while at step 7003 the instant coolant temperature is compared with the derived value. If the sampled coolant temperature is still below that required (in this case TARGET $+2.0°$ C.) then the program recycles allowing more coolant to be introduced into the radiator and for the coolant level in the coolant jacket to be maintained at H1 by the coolant level control routine.

Upon the temperature of the coolant raising to a value which proximates the desired TARGET $-\alpha 6$) (where $\alpha 6 = 2.0°$ C.) then at step 7004 the valves are conditioned as shown to terminate the influx of coolant and maintain the amount of coolant in the cooling circuit as is for the instant.

As will be appreciated, the above described pressure increasing program is initiated upon the temperature of the coolant falling below the desired TARGET level by a predetermined amount which in the instant embodiment is selected to be 3.0°. The program however, is effective in reducing this difference by 1.0° C. before terminating and thus brings the temperature control back within the range indicated as being allowable in step 1004 of FIG. 11. On the other hand, if the temperature detection and comparison carried out in step 1004 indicates that the temperature is above TARGET by $\alpha 3$ (viz., 2.0° C.) then the pressure reducing program functions to bring the temperature back within the range of TARGET $+\alpha 3$ to TARGET $-\alpha 4$.

As will be appreciated the embodiments of the present invention permit very rapid correction of any deviations of the coolant system especially under conditions wherein control using the fan alone cannot produce the desired results.

Due to the very rapid repetition rate of the above described programs, ON-OFF control of the valves (604, 602 and 616) fan 230 and pump 234 occur in a manner to enable the desired temperature control within a very short period of time.

What is claimed is:

1. In an internal combustion engine a structure subject to high heat flux a cooling circuit for removing heat from said structure, said circuit comprising:

a coolant jacket formed about said structure and into which coolant is introduced in liquid form and permitted to boil.

a radiator in which gaseous coolant is condensed to its liquid state, said radiator fluidly communicating with said coolant jacket via a vapor transfer conduit, and coolant return means for returning liquid coolant from said radiator to said coolant jacket in a manner to maintain said structure immersed in a predetermined depth of liquid coolant; and means for varying the amount of liquid coolant in said cooling circuit in a manner which controls the pressure prevailing within said cooling circuit.

2. An internal combustion engine comprising a structure subject to high heat flux and a cooling circuit for removing heat from said structure, said cooling circuit comprising:

a coolant jacket formed about said structure and into which coolant is introduced in liquid form and permitted to boil;

a radiator in which gaseous coolant is condensed to its liquid state, said radiator fluidly communicating with said coolant jacket via a vapor transfer conduit;

coolant return means for returning liquid coolant from said radiator to said coolant jacket in a manner to maintain said structure immersed in a predetermined depth of liquid coolant; and means for varying the amount of liquid coolant in said cooling circuit in manner which controls the pressure prevailing within said cooling circuit, wherein said liquid coolant varying means takes the form of:

pressure detection means responsive to a parameter which varies with the pressure in said cooling circuit for outputting a signal indicative of the pressure prevailing in said cooling circuit;

a reservoir located externally of and fluidly discrete from said cooling circuit; and flow control means responsive to said pressure detection means for controlling the amount of coolant which flows between said reservoir and said cooling circuit.

3. An engine as claimed in claim 2, wherein said reservoir is hermetically sealed against invasion of atmospheric air and collapsible to permit the volume thereof to be varied while maintained completely filled with liquid coolant.

4. An internal combustion engine comprising a structure subject to high heat flux and a cooling circuit for removing heat from said structure, said cooling circuit comprising:

a coolant jacket formed about said structure and into which coolant is introduced in liquid form and permitted to boil;

a radiator in which gaseous coolant is condensed to its liquid state, said radiator fluidly communicating with said coolant jacket via a vapor transfer conduit;

coolant return means for returning liquid coolant from said radiator to said coolant jacket in a manner to maintain said structure immersed in a predetermined depth of liquid coolant;

means for varying the amount of liquid coolant in said cooling circuit in a manner which controls the pressure prevailing within said cooling circuit;

a device associated with said radiator for controlling the rate of condensation therein; and engine operational mode detection means for detecting the mode of engine operation and for controlling said device in a manner that the appropriate rate of condensation is induced which changes the temperature of the coolant in said coolant jacket to one of two preselected values in accordance with the detected mode of engine operation, said engine operation detecting means comprising an engine speed sensor and an engine load sensor.

5. In an internal combustion engine a structure subject to high heat flux;

a cooling circuit for removing heat from said structure, said cooling circuit comprising;

a coolant jacket formed about said structure and into which coolant is introduced in liquid form and allowed to boil;

a radiator in which gaseous coolant is condensed to its liquid form, said radiator fluidly communicating with said coolant jacket via a vapor transfer conduit; and coolant return means for returning liquid coolant from said radiator to said coolant jacket in a manner to maintain said structure immersed in a predetermined depth of liquid coolant;

pressure detection means responsive to a parameter which varies with the pressure prevailing in said cooling circuit for outputting a signal indicative thereof;

means defining a variable volume chamber; said variable volume chamber being in constant fluid communication with said cooling circuit and sealed against the invasion of atmospheric air; and a motor for forcibly varying the volume of said chamber and for forcing liquid coolant to flow between said reservoir and said cooling circuit, said motor being responsive to said pressure detection means.

6. A method of cooling an internal engine comprising the steps of:

introducing liquid coolant into a coolant jacket disposed about structure of the engine subject to high heat flux;

permitting the liquid coolant to boil and produced coolant vapor;

condensing the coolant vapor in a condenser;

modifying the rate at which the coolant vapor is condensed using a device which modifies the heat exchange between the radiator and a cooling medium which surrounds the condensor; and varying the pressure in said coolant jacket and said condenser by varying the amount of coolant contained in the coolant jacket and the condenser.

7. A method as claimed in claim 6, wherein said step of varying includes:

varying the pressure prevailing in a reservoir which fluidly communicates with the coolant jacket and the condenser so as to induce coolant to flow between said reservoir and said coolant jacket and radiator.

8. A method as claimed in claim 7, further comprising the step of:

sensing an operational parameter of the engine;

determining the temperature at which the coolant should be controlled to boil in response to said step of sensing;

controlling the operation of said device and the amount of coolant in the coolant jacket and radiator in a manner which induces the coolant to boil at the temperature determined in said determining step.

9. A method as claimed in claim 7, further comprising the steps of:

storing coolant in a hermetically sealed collapsible variable volume chamber;

using the pressure differential which exists between said coolant jacket and the ambient atmosphere to (a) transfer liquid coolant between said hermetically sealed collapsible chamber and a closed loop cooling circuit which includes said coolant jacket and said radiator and which excludes said chamber, and (b) vary the total amount of coolant contained in the cooling circuit; and maintaining said chamber completely full of liquid coolant at all times.

10. In an internal combustion engine a structure subject to high heat flux;

a loop cooling circuit for removing heat from said structure, said loop circuit comprising:

a coolant jacket formed about said structure and into which coolant is introduced in liquid form and permitted to boil;

a radiator in which gaseous coolant is condensed to its liquid state, said radiator fluidly communicating with said coolant jacket via a vapor transfer conduit; and coolant return means for returning liquid coolant from said coolant jacket in a manner to maintain said structure immersed in a predetermined depth of liquid coolant; and means using a pressure differential as a motive force for (a) moving liquid coolant between said closed loop cooling circuit and a source discrete therefrom and (b) varying the total amount of liquid coolant in said closed loop cooling circuit in a manner which controls the pressure prevailing therein and which varies the internal surface of said radiator which is immersed in liquid coolant.

11. In an internal combustion engine, a structure subject to high heat flux; and a cooling circuit for removing heat from said structure, said circuit comprising:

a coolant jacket formed about said structure and into which coolant is introduced in liquid form and is permited to boil;

a radiator in which gaseous coolant is condensed to its liquid state, said radiator fluidly communicating with said coolant jacket via a vapor transfer conduit; and coolant return means for returning liquid coolant from said radiator to said coolant jacket in a manner to maintain said structure immersed in a predetermined depth of liquid coolant; and means for varying the amount of liquid coolant in said cooling circuit in a manner which controls the pressure prevailing within said cooling circuit, said liquid coolant varying means including:

pressure detection means responsive to a parameter which varies with the pressure in said cooling circuit for outputting a signal indicative of the pressure prevailing in said cooling circuit;

a variable volume reservoir located externally of said cooling circuit and sealed against the invasion of air; and flow control means responsive to said pressure detection means for controlling the amount of coolant which flows between said reservoir and said cooling circuit.

12. In an internal combustion engine, a structure subject to high heat flux; and a cooling circuit for removing heat from said structure, said circuit comprising:

a coolant jacket formed about said structure and into which coolant is introduced in liquid form and is permitted to boil;

a radiator in which gaseous coolant is condensed to its liquid state, said radiator fluidly communicating with said coolant jacket via a vapor transfer conduit; and coolant return means for returning liquid coolant from said radiator to said coolant jacket in a manner to maintain said structure immersed in a predetermined depth of liquid coolant; and means for varying the amount of liquid coolant in said cooling circuit in a manner which controls the pressure prevailing within said cooling circuit, said liquid coolant varying means including:

pressure detection means responsive to a parameter which varies with the pressure in said cooling circuit for outputting a signal indicative of the pressure prevailing in said cooling circuit;

a reservoir located externally of said cooling circuit; and flow control means responsive to said pressure detection means for controlling the amount of coolant which flows between said reservoir and said cooling circuit;

wherein said reservoir includes a motor for varying the volume of said reservoir and for forcing fluid to flow between said reservoir and said cooling circuit, said motor being responsive to said pressure detection means.

13. A method of cooling an internal engine comprising the steps of:

introducing liquid coolant into a coolant jacket disposed about structure of the engine subject to high heat flux;

permitting the liquid coolant to boil and produce coolant vapor;

condensing the coolant vapor in a condenser;

modifying the rate at which the coolant vapor is condensed using a device which modifies the heat exchange between the radiator and a cooling medium which surrounds the condenser;

varying the pressure in said coolant jacket and said condenser by varying the amount of coolant contained in the coolant jacket and the condenser;

varying the pressure prevailing in a reservoir which fluidly communicates with the coolant jacket and the condenser so as to induce coolant to flow between said reservoir and said coolant jacket and radiator;

storing coolant in a variable volume chamber; and using a motor to vary the volume of said chamber and pressurize the coolant contained in said variable volume chamber in a manner which induces the coolant to flow between said reservoir and said coolant jacket and condenser.

* * * * *